United States Patent [19]

Holodnak et al.

[11] Patent Number: 4,615,519

[45] Date of Patent: Oct. 7, 1986

[54] MAIL SEPARATING DEVICE

[75] Inventors: Richard S. Holodnak, Stratford; Clinton E. Hooper, Brookfield, both of Conn.

[73] Assignee: Pitney Bowes Inc., Stamford, Conn.

[21] Appl. No.: 692,953

[22] Filed: Jan. 22, 1985

[51] Int. Cl.[4] ..... B65H 3/52

[52] U.S. Cl. ..... 271/122; 271/124

[58] Field of Search ..... 271/122, 124, 125

[56] References Cited

U.S. PATENT DOCUMENTS 3,052,465 9/1962 David ..... 271/122

3,635,465 10/1972 Beery ..... 271/122

*Primary Examiner*—Richard A. Schacher

*Attorney, Agent, or Firm*—Martin D. Wittstein; William D. Soltow, Jr.; Albert W. Scribner

[57] ABSTRACT

In a mail processing machine, there is at least one mail piece separating and feeding device for handling vertically oriented mail pieces to assure that only one mail piece at a time is fed into the mail processing machine. A feeding roller is positioned in a feed path defined by guide plates to keep the mail pieces in a vertical orientation, and a separator belt is mounted on a plurality of rollers mounted on a bell crank, one of the rollers being a drive roller. The bell crank is resiliently urged toward an adjustable stop member so that, a predetermined minimum gap is maintained between the outer surface of the belt and the adjacent surface of the feeding roller regardless of the extend of wear on the belt.

8 Claims, 6 Drawing Figures

MAIL SEPARATING DEVICE

BACKGROUND OF THE INVENTION

1. Field of the Invention

The present invention relates generally to the field of mail processing machines and more particularly to mail processing machines in which a plurality of mixed mail pieces of varying length and thickness are stored on a supply tray and are separated and fed seriatim therefrom to a path of travel which extends through a mail processing machine.

A typical mail processing machine with which the present invention is concerned comprises a series of modules, components or subassemblies which perform independent functions on the mail pieces. For example, mail is stacked in a feed tray unsealed and is fed seriatim first to a device which opens the flap of each envelope, moistens the sealing edge and then presses the flap to seal the envelope. The sealed envelope is then fed to a mailing machine which prints a postage indicia in the upper right hand corner of the envelope in known manner. Finally, the envelope is fed to a stacking device which accumulates the mail pieces in a suitable receiving tray.

Typically, mail processing machines of the type described above are capable of operating at a rather high rate of speed, usually in the order of 100 to 300 pieces of mail per minute. At this rate of movement, it is absolutely essential that the mail pieces enter the feed path of the mail processing machine only one at a time and not in overlapped relationship. If more than one mail piece enters the mail processing machine, a jam will occur, resulting in possible damage to the mail pieces or some part of the mail processing machine or both.

It is the inherent nature of friction type sheet separating devices that they are less than perfect, and occasionally a plurality of mail pieces will enter the feed path of the mail processing machine notwithstanding the presence of a separating device at the feed end of the supply of mail pieces being fed into the mail processing machine. To avoid the aforementioned undesirable consequences of this happening, one or more separating devices are inserted in the feed path in advance of the first mail processing station to assure that only one mail piece at a time reaches the processing station. This type of arrangement has proven to be very effective to the point that when two separating devices are placed in series in the feed path, the probability of a pair of mail pieces being fed into the mail processing simultaneously is virtually nil.

The most efficient type of separating device for high speed mail processing machines is the continuation of a high friction feed roller rotating in a direction such as to feed an envelope along a feed path, and a lower friction endless belt separator adjacent the feed roller which moves in a direction such that the outer surface of the belt where it is adjacent to the peripheral surface of the feed roller moves in a direction opposite to that of the peripheral surface of the feed roller. With this arrangement, the feed roller feeds a mail piece in the desired direction notwithstanding any force applied by the belt to move the mail piece in the opposite direction because the feed roller has a higher coefficient of friction with the mail piece than does the belt. However, if two mail pieces are fed to the separator device simultaneously, the belt will hold back one mail piece while he feed roller feeds the other because the surface material of the belt has a higher coefficient of friction with the mail piece than do the two mail pieces sliding together.

One major disadvantage with the above described type of mail piece separating device is that the most satisfactory type of belts have an excessively high rate of wear. In fact, it is not uncommon for an operator of a typical mail processing machine to have to change separating belts with sufficient frequency that in an installation having several mail processing machines, each with several separating belts, belt replacement becomes a significant problem. Ordinarily, a small gap is maintained between the adjacent surfaces of the feed roller and the belt, so that mail pieces of normal thickness can be fed through the gap without any difficulty. The belt is mounted in such a way that it is movable toward and away from the feed roller in order to accommodate either thick or plural mail pieces, the former being fed past the separator belt and the latter being separated as described above. However, the mechanism on which the belt is mounted is limited to a specific amount of movement regardless of the thickness of the belt. What happens as the belt wears is that the gap between the belt surface and the roller surface gradually widens to the point where there is insufficient friction between the belt and a mail piece to assure proper separation of plural mail pieces, with the result that the mail pieces are simultaneously fed into the mail processing machine.

2. The Prior Art

The prior art is replete with various types of separating devices for a large variety of items such as sheets of various materials, mail pieces and various flat articles. Three U.S Pat. Nos. 3,373,685, 3,773,317 and 3,970,298 are typical examples of different types of combination roller and belt separating devices, although in these patents a belt functions as the feeding device and a roller functions as the separating device. No prior art is presently known which addresses the problem of belt wear in a combination roller-belt separating device where the roller is the feeding element and the belt is the separating element.

Another U.S. Pat. No. 2,140,171 issued to Francis J. Rouan, assignee to Pitney Bowes Inc., discloses a Feed and Separator Roller Wear Compensator for a mail handling machine. There is a compensating means disclosed which adjusts itself according to wear upon a feed roller and an adjacent separator roller. However, the apparatus disclosed depends for its operation on plural compensating devices acting simultaneously on adjacent feed and separator rollers to maintain a predetermined minimum gap therebetween, and therefore is very complex in construction and difficult to maintain in operation.

SUMMARY OF THE INVENTION

The present invention greatly obviates, if not substantially eliminates, the above-described disadvantages of roller-belt separating devices by providing a device in which the belt is mounted in such a way that the position of the belt adjacent to the feed roller is not only movable toward and away from the feed roller, but is movable in this manner over a variable range so that the gap between the adjacent surfaces of the feed roller and the belt can be maintained at a predetermined minimum. Thus the mounting structure for the belt is self compensating so that the separating surface of the belt can be held in a predetermined relationship with the surface of the feed roller regardless of the degree of wear on the belt.

To this end, the present invention comprises, in its broader aspects, a device for separating and feeding mail pieces having guide elements which define a path of travel for mail pieces and feed elements located adjacent to the path of travel, and there is a separating device for each feeding element located adjacent each feeding element but on the opposite side of the path of travel from the feeding element. Each separating device includes a support member such as a bell crank or similar shaped unitary linkage pivotally mounted adjacent the feeding element such that one end of the bell crank is closely adjacent to the feeding element and the other end is remote from the feeding element. An idler roller is rotatably mounted on each end of the bell crank and a drive roller is rotatably mounted on the pivot axis of the bell crank. An endless belt extends around the aforementioned rollers and is driven in a direction such that the outer surface of the belt moves in a direction opposite to that of the adjacent driving surface of the feed roller. Finally, there is an adjustment mechanism for adjusting a predetermined limit position of the bell crank for maintaining a predetermined minimum gap between the outer surface of the belt and the adjacent driving surface of the feeding element regardless of the extent of wear on the belt.

Thus, it is a principal object of the present invention to provide a feeding and separating device in which the separating belt can be used for a far greater length of time than is heretofore possible because the critical gap between the feed roller and the belt is adjustable to accommodate wear on the belt. Being able to utilize the belt for a considerably greater length of time eliminates the need for frequent belt changing and thereby greatly reduces the cost of maintenance and down time on the mail processing machine ordinarily necessitated by frequent belt changes.

Other objects and advantages of the present invention will become apparent from an understanding of the following detailed description of a presently preferred embodiment of the present invention when considered in conjunction with the accompanying drawings in which.

DETAILED DESCRIPTION OF THE INVENTION

Figure 1:
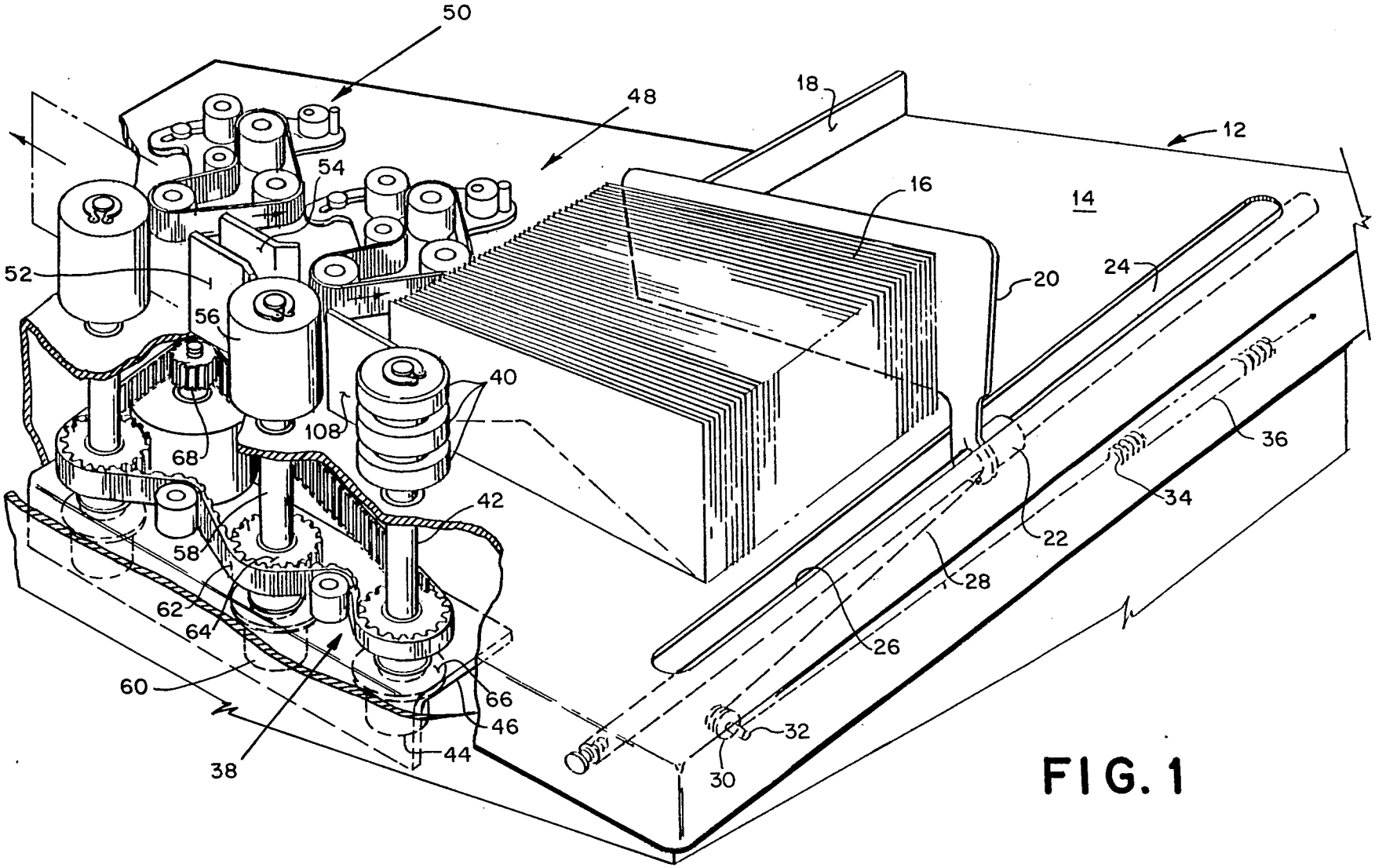
FIG. 1 is a partial isometric view of a separating and feeding apparatus for feeding mixed mail pieces into a mail processing machine and includes the separating and feeding device of the present invention.

Referring now to the drawings and more particularly to FIG. 1 thereof, there is seen the input or infeed end of a mail processing machine generally designated by the reference numeral 10, and which comprises a suitable mail piece supply component generally designated by the numeral 12. The supply component 12 includes a support or table surface 14 on which a stack 16 of mail pieces having varying length and thickness is placed. A suitable rail 18 extends along our side edge of the surface 14 and constitutes a registration guide against which one end of each mail piece is placed so that the mail pieces are aligned at that end. It is mentioned at this point that a copending patent application entitled "Mail Separating Apparatus" assigned to Pitney Bowes Inc. by Richard Holodnak may be referred to in order to understand more of the upstream feeding apparatus of the mail processing machine 10.

A pusher member 20 is connected to an elongate bearing 22 which slides on an elongate rail 24 mounted beneath the surface 14 and which is accessible through an elongate slot 26 formed in the surface 24. A flexible cable 28 is connected to one end of the bearing 22 and extends around a roller 30 rotatably mounted on a shaft which is suitably mounted on the support component 12. The other end of the cable 28 is connected to one end 34 of a tension spring 36 which maintains a constant pull on the cable 28 so as to cause the pusher member 20 to continuously urge the mail pieces 16 toward a separating and feeding device generally designated by the numeral 38 and located at one end of the support component 12.

The separating and feeding device 38 comprises a plurality of rubber tires 40 mounted on vertically oriented shaft 42 rotatably mounted in a bearing 44 carried by a portion of a frame 46 of the mail processing machine. The tires 40 are rotated by means described below in a direction such that the peripheral surfaces thereof contact the adjacent mail piece in the stack 16 and urge that mail piece forwardly or to the left as viewed in FIG. 1 under ideal operating conditions, the difference in the friction driving force between the tires 40 and the adjacent envelope, on the one hand, and two adjacent envelopes on the other hand, is sufficiently enough that only one envelope at a time will be fed from the stack 16. In the event that two or more envelopes are fed simultaneously from the stack 16 or are fed in partial overlapping relationship, a plurality of additional separating and feeding devices generally designated by the numerals 48 and 50 are disposed in series relationship along the feed path in the mail processing machine, but in advance of any of the processing stations. Any number of such separator and feeding devices can be installed, and since they are identical in construction, only one such device will be described.

Figure 2:
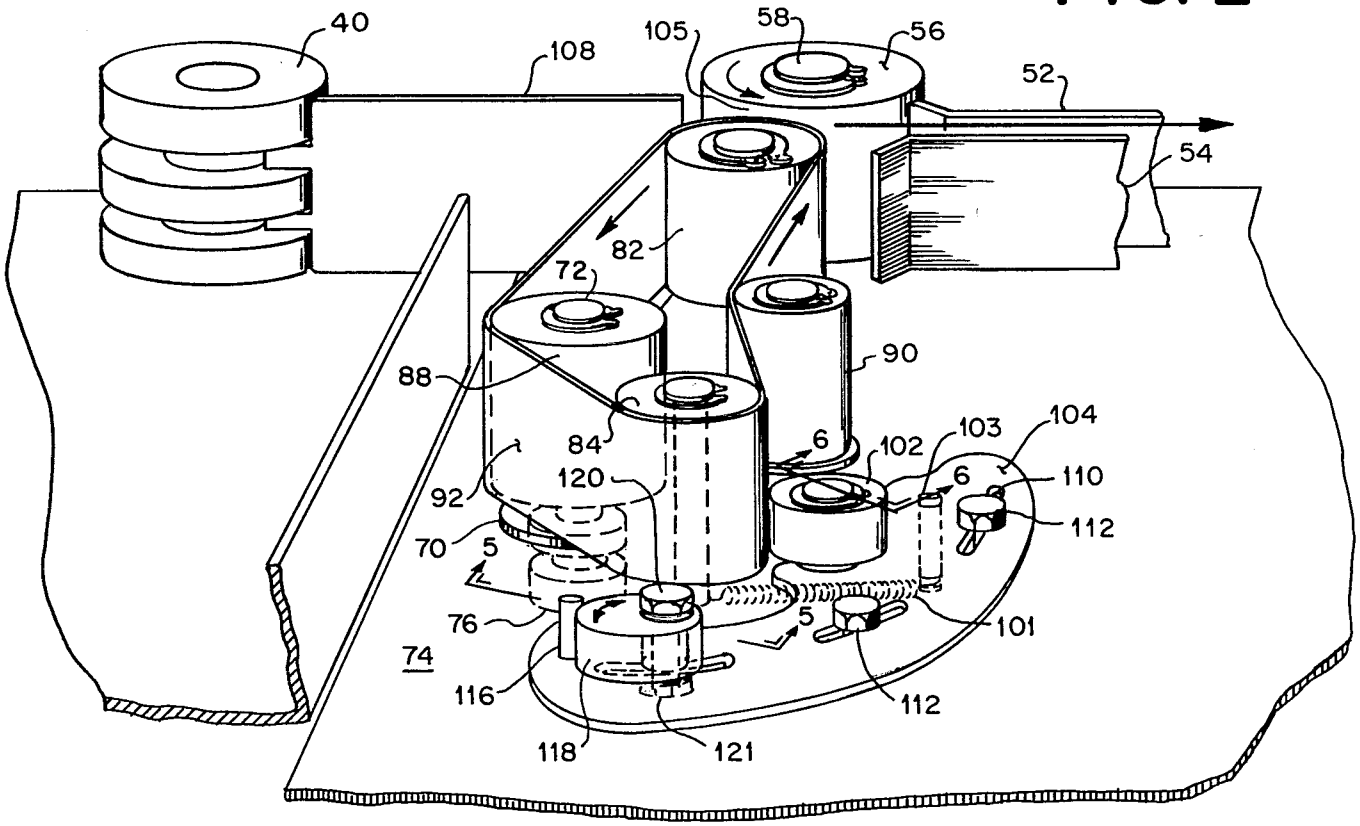
FIG. 2 is a partial isometric view drawn to an enlarged scale of one of the separating and feeding devices shown in FIG. 1.
Figure 3:
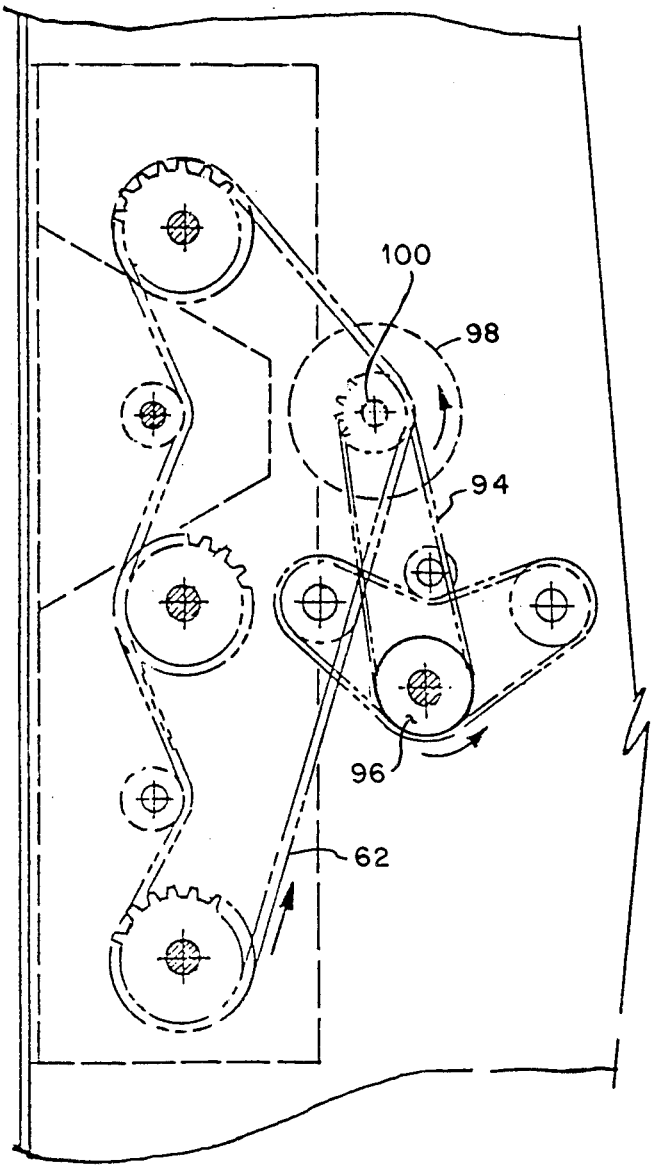
FIG. 3 is a partial sectional view taken along the line 3—3 of FIG. 1 showing the drive means for the separating and feeding device.
Figure 4:
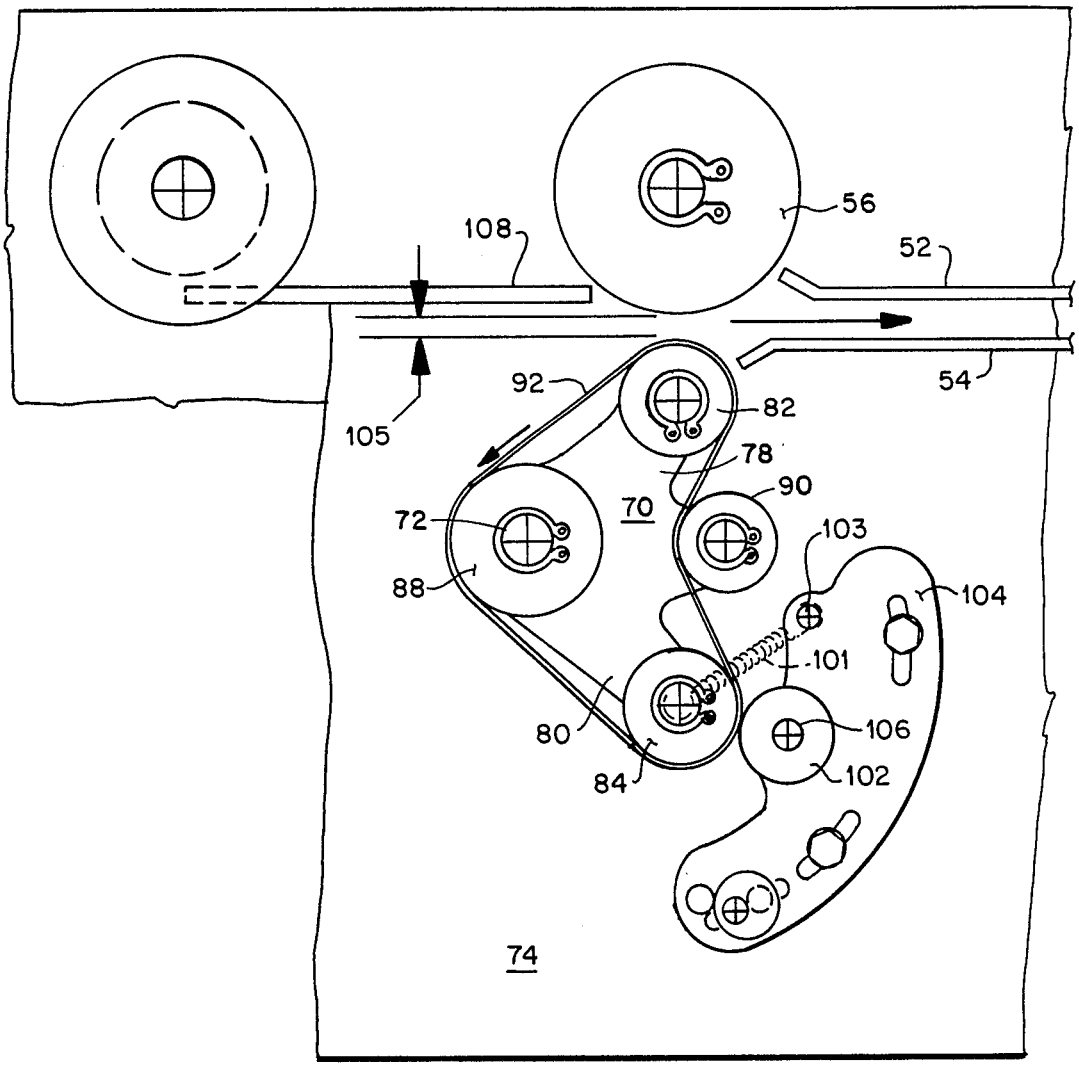
FIG. 4 is a partial plan view of the separating and feeding device shown in FIG. 2.
Figure 5:
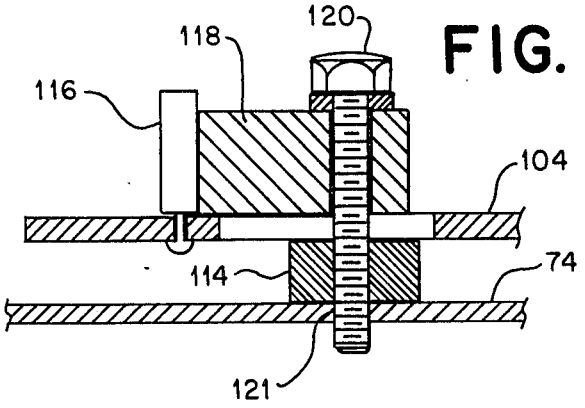
FIG. 5 is a sectional view taken on the line 5—5 of FIG. 2 showing the coarse adjustment means of the separating and feeding device.

Referring now to FIGS. 1 and 2, it will be seen that a pair of upstanding guide plates 52 and 54 are disposed adjacent to the feed end of the stack of mail pieces 16, the guide plates 52 and 54 in part defining a feed path commencing with the separating and feeding device 38 and extending through the separating and feeding devices 48 and 50 and into the mail processing machine. The separating and feeding device 48 comprises a feeding element in the form of a rotating friction roller 56 mounted on a shaft 58 which is rotatably carried by a bearing 60 supported by the frame portion 46. The roller 56 and shaft 58 are driven by a timing belt 62 which engages with a timing pulley 64 fixedly mounted on the shaft 58. It should be noted that the timing belt 62 also drives the tires 40 by means of a timing pulley 66 fixedly mounted on the shaft 42. The timing belt 62 is driven by a timing pulley 68 which is driven from any suitable source. It is apparent that the feed roller 56 is driven to rotate in the same directions as the tires 40. The separation portion of the separating and feeding device 48 is disposed on the opposite side of the feed path from the feed roller 56 and is best seen in FIGS. 2 and 4. This assembly comprises a bell crank 70 rotatably mounted on a shaft 72 rotatably mounted on a bearing 76 to a plate 74 which forms part of the frame of the mail handling machine. The bell crank 70 has a pair of arms 78 and 80, the arm 78 being disposed adjacent to the feed roller 56. A pair of rollers 82 and 84 are rotatably mounted on the ends 78 and 80 of the bell crank 70. A drive roller 88 is fixedly mounted on the upper end of the shaft 72 for rotation therewith. Another roller 90 is rotatably mounted on an intermediate portion of the bell crank 70. A belt 92 passes around the rollers 82, 84, 88 and 90 and is driven by the drive roller 88 in a direction such that the outer peripheral surface of the belt 92 is moving in the opposite direction from the outer peripheral surface of the feed roller 56 where the surfaces are adjacent, as indicated by the arrows in FIG. 2. As best seen in FIG. 3, the drive roller 88 and connected drive shaft 72 are driven by a timing belt 94 through a timing pulley 96 mounted on the shaft 72. Both the timing belt 94 and the timing belt 62 previously described are driven by a motor 98 through suitable timing pulleys mounted on the motor shaft 100.

Referring back to FIGS. 2 and 4, it will be seen that the bell crank 70 is urged in a counter-clockwise direction about the drive shaft 72 by a tension spring 101 suitably connected to the bell crank and to a stud 103 mounted on a fixed plate 104 so that the portion of the belt 92 which passes around the roller 82 is continuously urged toward the feed roller 56. The portion of the belt 92 which passes around the other idler roller 84 contacts an idler roller 102 which is rotatably mounted on a stub shaft 106 fixedly secured to the plate 104 which is adjustably connected to the plate 74 in a manner described below. The roller 102 forms a stop for the bell crank 70 in order to limit the amount of counter-clockwise movement permitted by the bell crank 70 in order to maintain a predetermined minimum gap 105 between the surface of the belt 92 and the feed roller 56 where they are most closely adjacent.

With this arrangement, it will be seen in FIG. 4 that the portion of the belt 92 which extends between the drive roller 88 and the idler roller 82 forms a gradually decreasing throat with a guide plate 108 which forms part of the feed path with the guide plates 52 and 54.

In order to maintain the predetermined minimum gap 105 between the adjacent surfaces of the feed roller 56 and the belt 92, an adjustment mechanism has been provided so that the limit position of the bell crank 70 in the counter-clockwise direction of movement can be varied as the belt 92 wears and thereby undergoes a reduction in thickness. The adjustment mechanism provides a two stage adjustment, as will be seen, so that after an initial adjustment is made, a further adjustment can be made which is of much smaller range than is the initial adjustment.

Figure 6:
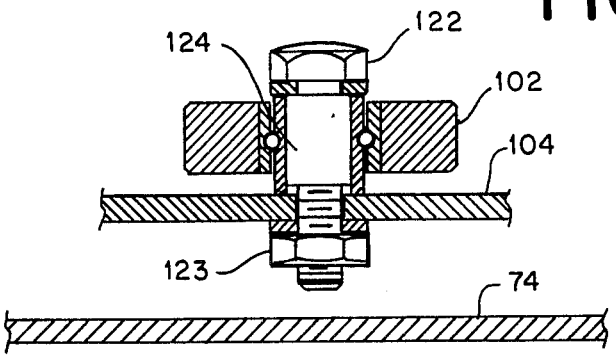
FIG. 6 is a sectional view taken on the line 6—6 of FIG. 2 showing the fine adjustment means of the separating and feeding device.

The first stage, or coarse, adjustment is accomplished by adjustably mounting the plate 104 on the plate 74 in an arcuate manner. Thus, as best seen in FIGS. 2 and 4, the plate 104 has a plurality of arcuate slots 110 through which pass a pair of bolts 112 which are secured to the frame portion 74. A pair of spacers 114 are interposed between the underside of the plate 104 and the upper surface of the frame portion 74 in order to maintain the plate 104 in spaced relationship with the frame portion 74 in order to provide space for the spring 101 and the pin 103. The plate 104 can be secured to the frame portion 74 in any position within the range of movement permitted by the slots 110 simply by tightening the bolts 112. Movement of the plate 104 to a desired position is facilitated by means of an adjustable abutment which comprises an upstanding pin 116 mounted on the end of the plate 104, which abuts against an eccentric member 118 which is rotatably mounted on a bolt 120 which is also secured to the frame portion 74, as best seen in FIG. 6.

Thus, when the bolts 112 and the bolt 120 are loosened, the eccentric member 118, which may optionally be provided with suitable marking, is rotated to locate the plate 104 in a desired position within the limits of the arcuate slots 110, after which the bolts 112 and the bolt 120 are tightened against an appropriate threaded hole 121 so as to lock the plate 104 to the frame portion 74. In actual practice, a 180° rotation of the eccentric member 118 provides approximately one quarter of an inch arcuate movement of the plate 104. Because of the location of the roller 102 on the plate 104, the roller 102 is also moved the same distance with respect to the adjacent surface of the belt 92, with the result that the ends of the respective arms 78 and 80 of the bell crank 70 can also move by the same amount when the plate 104 is moved. In other words, the gap 105 between the adjacent surfaces of the feed roller 56 and the belt 92 can be adjusted within the same range of movement as that permitted by the relationship between the arcuate slots 110 and the bolts 112 and 120.

In addition to the coarse adjustment just described, means are provided for making a very fine adjustment of the limit position of the bell crank 70 which can be made independently of the coarse adjustment. To accomplish this, and with reference to FIGS. 2 and 6, it will be seen that the roller 102, which is the limit position stop member for the belt 92 and the bell crank 70, is mounted on the plate 104 by means of a bolt 122 which is secured to the plate 104 by a nut 123. The bolt 122 has an eccentric shoulder 124 which turns with the bolt 122, and thus when the bolt 122 is rotated, the roller 102 is shifted in an orbital path with respect to the axis of the bolt 122 toward and away from the belt 92. Since the bell crank 70 is continuously urged in a counter-clockwise direction by the spring 101, the belt 92 will remain in contact with the roller 102 regardless of the position in which it is placed by rotation of the bolt 122. Thus, as the location of the roller 102 is shifted, the bell crank 70 oscillates by a small increment so as to increase or decrease the gap between the belt 92 and the periphery of the feed roller 56.

In actual practice, the coarse adjustment means controlled by the eccentric member 118 and the pin 116 is effective to move the bell crank 70 over a range of approximately one quarter of an inch in order to maintain the predetermined minimum gap 105 between the outer surface of the belt 92 and the peripheral surface of the feed roller 56. The principal purpose for the coarse adjustment means is to set the bell crank 70 to an initial position during assembly of the apparatus so that the gap 105 between the outer surface of the belt 92 and the peripheral surface of the feed roller 56 is as close as possible to the desired predetermined minimum. This adjustment functions to compensate mainly for variations in tolerance accumulations in the parts of the device as they are assembled together.

Because of the extremely small size of the gap 105 which must be maintained for proper operation, the coarse adjustment means is generally not capable of providing the small degree of adjustment which is necessary. To understand this better, it should be appreciated that the outer surface of the belt 92 and the peripheral surface of the roller 56 must not be in contact since these surfaces are moving in opposite directions and such contact would cause extreme wear during operation of the device. On the other hand, these surfaces must normally be maintained sufficiently close together that two pieces of the thinnest mail contemplated for processing by the mail processing machine cannot pass between the belt and feed roller surfaces simultaneously. For example, in order to separate two post cards or two pieces of air mail which are sometimes tissue paper thin, a gap in the order of 0.007 to 0.008 of an inch is normally maintained between the outer surface of the belt 92 and the peripheral surface of the feed roller 56. Thus, the fine adjustment means controlled by the roller 102 and the surface of the belt 92 is effective to move the belt surface toward and away from the peripheral surface of the feed roller 56 over a range of only 30 to 40 thousandths of an inch so that the position of the bell crank can be set to maintain the 0.007 to 0.008 of an inch gap between these surfaces.

It will be apparent from the foregoing that as the belt 92 wears and decreases in thickness, the predetermined minimum gap 105 between the belt surface and the peripheral surface of the feed roller 56 will remain constant when the belt supporting assembly is in its normal position. Since the outer surface of the belt 92 always contacts the roller 102, as the belt gradually gets thinner, the belt supporting assembly moves slightly in a counter-clockwise direction so that the belt surface moves toward the roller 56 thereby maintaining the same preset gap.

Therefore, having described the present invention in the foregoing specification, it will be apparent that a feeding and separation device is provided in which the utility of the device is extended beyond what is now currently known or utilized. Further, the advantages and objectives of the present invention have been achieved. It is to be understood however, that the invention is not to be considered as limited to the specific embodiment described above and shown in the accompanying drawings which embodiment is merely illustrative of the best mode for carrying out the invention and is susceptible to change in form, size, detail, and arrangement of parts, but rather that the invention is intended to cover all such variations, modifications and equivalents thereof as may be deemed to be within the scope of the claims appended hereto.

What is claimed is:

1. A device for separating and feeding a vertically oriented mail piece from a plurality of vertically oriented mail pieces moving along a path of travel through a mail processing machine, said device comprising:

A. guide means defining a path of travel for vertically oriented mail pieces,

B. feeding means disposed adjacent said guide means for feeding mail pieces seriatim along said path of travel, C. separating means disposed adjacent said guide means but on the opposite side of said path of travel from said feeding means for separating multiple mail pieces so that only a single mail piece is fed by said feeding means, said separating means comprising (1) a support member pivotally mounted adjacent said feeding means, said support member having a first portion disposed closely adjacent to said feeding means and having a second portion disposed remote from said feeding means, (2) a roller rotatably mounted on each portion of said support member, (3) a drive roller mounted on the pivot axis of said support member, (4) an endless belt extending around said first mentioned rollers and said drive roller, (5) means for driving said drive roller in a direction such that the outer surface of said belt moves in a direction opposite to that of the adjacent driving surface of said feeding means, and D. means for adjusting a predetermined limit position of said pivotal movement of said support member for maintaining a predetermined minimum gap between said outer surface of said belt and said adjacent driving surface of said feeding means regardless of the extent of wear on said belt or said feeding means.

2. A device as set forth in claim 1 wherein said means for adjusting the predetermined limit position of said pivotal movement of said support member comprises a first and second adjusting means, said first adjusting means being effective to preset said predetermined limit position over a relatively wide range and said second adjusting means being effective to preset said predetermined limit position over a relatively small range.

3. A device as set forth in claim 2 wherein said first adjusting means comprises a plate on which said separating means is mounted, an abutment roller mounted on said plate against which the outer surface of said belt bears, and means for adjustably moving said plate with said abutment roller in a direction so as to move said belt surface toward and away from said feeding means.

4. A device as set forth in claim 3 said second adjusting means comprises means for moving the outer surface of said abutment roller relative to said plate in a direction so as to move said belt surface toward and away from said feeding means.

5. A device as set forth in claim 1 wherein said adjusting means comprises means operatively associated with said outer surface of said belt for maintaining said predetermined minimum gap between said outer surface of said belt and said adjacent surface of said feeding means.

6. A device as set forth in claim 1 wherein said adjusting means comprises an abutment roller adjustably fixedly mounted with respect to said support member adjacent said second portion thereof, and resilient means normally urging said support member in a pivotal direction so as to maintain said outer surface of said belt in contact with said abutment roller so that said first portion of said support member is maintained closely adjacent to said feeding means.

7. A device as set forth in claim 6 wherein said abutment roller is rotatably mounted on a bolt having an eccentric shoulder such that when said bolt is rotated, the axis of rotation of said roller is moved so that said minimum gap between said outer surface of said belt and said feeding means can be adjusted.

8. A device as set forth in claim 7 wherein said adjusting means further comprises a plate on which said bolt and abutment roller are mounted, and means connecting said plate to a frame position of said separating and feeding device for limited movement of said bolt and abutment roller toward and away said second portion of said support member, said connecting means including means for locking said plate in any position within the range of said limited movement.

* * * * *